US009225091B2

(12) United States Patent
Ju

(10) Patent No.: US 9,225,091 B2
(45) Date of Patent: Dec. 29, 2015

(54) ADAPTER AND ELECTRICAL CONNECTION SYSTEM

(71) Applicant: LOTES CO., LTD, Keelung (TW)

(72) Inventor: Ted Ju, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 14/247,905

(22) Filed: Apr. 8, 2014

(65) Prior Publication Data

US 2014/0315418 A1 Oct. 23, 2014

Related U.S. Application Data

(60) Provisional application No. 61/813,263, filed on Apr. 18, 2013.

(51) Int. Cl.

| | |
|---|---|
| ***H01R 12/88*** | (2011.01) |
| ***H01R 12/79*** | (2011.01) |
| *H01R 13/193* | (2006.01) |
| *H01R 12/77* | (2011.01) |
| *H01R 12/72* | (2011.01) |

(52) U.S. Cl.

CPC ..... *H01R 12/88* (2013.01); *H01R 12/79* (2013.01); *H01R 12/721* (2013.01); *H01R 12/774* (2013.01); *H01R 13/193* (2013.01)

(58) Field of Classification Search

CPC ..... H01R 12/88; H01R 12/79; H01R 12/774; H01R 13/193; H01R 2103/00

USPC ..... 439/260, 263, 73, 267, 637, 266

See application file for complete search history.

(56) References Cited

U.S. PATENT DOCUMENTS

| | | | | |
|---|---|---|---|---|
| 8,905,773 | B2 * | 12/2014 | Liang | H01R 12/87 439/260 |
| 2008/0233793 | A1 * | 9/2008 | Ju | H01R 12/79 439/493 |
| 2013/0267125 | A1 * | 10/2013 | Tai et al. | H01R 12/57 439/660 |

* cited by examiner

*Primary Examiner* — Abdullah Riyami
*Assistant Examiner* — Justin Kratt
(74) *Attorney, Agent, or Firm* — Locke Lord LLP; Tim Tingkang Xia, Esq.

(57) ABSTRACT

An electrical connection system includes an electrical connector electrically connected to a chip module, and an adapter disposed on one side of the electrical connector. The chip module laterally extends to form a conducting portion. Two rows of terminals are disposed in the adapter, and form a slot therebetween for the conducting portion to be inserted therein. When the conducting portion is not inserted in the slot, the width of the slot is greater than the thickness of the conducting portion, so that a zero insertion force is required for insertion of the chip module. After the chip module is inserted in the slot, under the effect of an external force, the width of the slot is reduced to an extent that the terminals urge against the conducting portion, which ensures close electrical connection between the terminals and the chip module.

20 Claims, 12 Drawing Sheets

ADAPTER AND ELECTRICAL CONNECTION SYSTEM

CROSS-REFERENCE TO RELATED APPLICATION

This non-provisional application claims priority and the benefit of U.S. Provisional Application No. 61/813,263, filed Apr. 18, 2013, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates generally to an adapter and an electrical connection system, and more particularly to an adapter and an electrical connection system that require a zero insertion force.

BACKGROUND OF THE INVENTION

In a signal transmission system disclosed by Chinese patent No. CN 200920058134.3, two or more electrical connectors are interconnected through multiple cables, so as to achieve interconnection between two or more chip modules. The signal transmission system includes a first chip module and a second chip module. The first chip module is mounted in a first receptacle connector and a first insertion portion is formed on one side of the first chip module. The second chip module is mounted in a second receptacle connector and a second insertion portion is formed on one side of the second chip module. A first edge connector for insertion of the first insertion portion is provided on one side of the first receptacle connector. A second edge connector for insertion of the second insertion portion is provided on one side of the second receptacle connector. The first edge connector and the second edge connector are electrically conducted through the cables, so as to achieve electrical conduction between the first chip module and the second chip module. The first edge connector includes an insulating body which is formed with an input end and an output end. The input end is provided with an insertion port in a depressed manner. Upper and lower sides of the insertion port are each provided with a row of signal terminals. The two rows of signal terminals are used for clamping the first insertion portion. The output end is connected to the cables.

The first edge connector is used for insertion of the first insertion portion. The two rows of signal terminals have elastic contact portions. When the first insertion portion is not inserted, the distance between the contact portions of the two rows of signal terminals is smaller than the thickness of the first insertion portion, so that a strong clamping force can be provided during the insertion, which prevents separation of the first insertion portion and the first edge connector. However, when the distance between the two rows of the contact portions is smaller than the thickness of the first insertion portion, a large insertion force is required for insertion of the first chip module in the edge connector. Therefore, when the first insertion portion is inserted in the first insertion port, a large insertion force is needed, and the terminals may wear out the first insertion portion, causing interruption of the electrical conduction.

Therefore, a heretofore unaddressed need exists in the art to address the aforementioned deficiencies and inadequacies.

SUMMARY OF THE INVENTION

In one aspect, the present invention is directed an adapter that require a zero insertion force.

In one embodiment, the adapter includes a first body having multiple first terminals disposed therein, a second body having multiple second terminals therein, and an elastic member urging against the first body and the second body. A slot is formed between the first terminals and the second terminals for insertion of a chip module. The chip module laterally extends to form a conducting portion to enter the slot. When the chip module is not inserted in the slot, the elastic member is urged against the first body and the second body, and the width of the slot is greater than the thickness of the conducting portion. After the chip module is inserted in the slot, a pressing force is applied to the first body to press against the elastic member, and the width of the slot is reduced to be equal to the thickness of the conducting portion.

In one embodiment, the elastic member is located between the first body and the second body.

In one embodiment, the adapter further includes a fixing plate and a pressing member. The fixing plate is located on one side of the first body away from the second body. The pressing member is pivotally connected on the fixing plate. When the conducting portion is not inserted in the slot, the pressing member is located at an open position. After the conducting portion is inserted in the slot, a pressing force is applied to the pressing member so that the pressing member rotates and provides a pressing force to the first body. Therefore, the first body moves toward the second body, and the first terminals and the second terminals urge against the conducting portion.

In one embodiment, the adapter further includes a pressing plate located between the fixing plate and the first body. When the pressing member rotates and presses the pressing plate, the pressing plate provides a pressing force to the first body.

In one embodiment, the pressing member has a pivotal connection portion pivotally connected to the fixing plate. A pressing portion is disposed on one end of the pressing member adjacent to the pivotal connection portion and provides a pressing force to the first body, and an operating portion is disposed on the other end of the pressing member away from the pressing portion.

In one embodiment, the pressing portion is in the shape of a cam.

In one embodiment, the fixing plate is provided with an opening for accommodating the pressing member.

In one embodiment, the adapter further includes a bottom plate located on one side of the second body away from the first body. Each of two ends of the bottom plate is provided with a buckling portion. Each of two ends of the fixing plate bends and extends to form a retaining portion. The buckling portions are engaged with the retaining portions.

In one embodiment, each of the first terminals and the second terminals has a contact portion in contact with the chip module, and a rear portion electrically connected to a coaxial cable.

In one embodiment, the first terminals include multiple signal terminals and multiple ground terminals. The signal terminal is in electrical contact with an inner conductor of the coaxial cable, and the ground terminal is in contact with an outer conductor of the coaxial cable.

In one embodiment, the adapter further includes a ground piece. The ground piece is welded to the outer conductors of the coaxial cables. The ground piece extends to form multiple ground pins which are welded to the ground terminals.

In one embodiment, a protruding block is provided on the first body and retains the second body to limit the displacement thereof.

In one embodiment, the adapter further includes a third body fixed on the first body. The first terminals and the second terminals extend into the third body and are disposed opposite to each other.

In one embodiment, the first body is insert-molded with the first terminals, and the second body is inserted-molded with the second terminals.

In another aspect, the present invention is directed to an electrical connection system that requires a zero insertion force.

In one embodiment, the electrical connection system includes an electrical connector and an adapter. The electrical connector is configured for electrically connecting a chip module. The chip module laterally extends to form a conducting portion. The adapter is disposed on one side of the electrical connector. Two rows of terminals are disposed in the adapter. A slot is formed between the two rows of terminals and provided for insertion of the conducting portion. When the conducting portion is not inserted in the slot, the width of the slot is greater than the thickness of the conducting portion. After the chip module is inserted in the slot, under the effect of an external force, the width of the slot is reduced to an extent that the terminals urge against the conducting portion.

In one embodiment, the electrical connector further includes a cover plate for pressing against the chip module. One side of the cover plate extends to form an urging portion, and the urging portion is urged against the adapter to provide a pressing force.

In one embodiment, the adapter further includes a fixing plate. The fixing plate is pivotally provided with a pressing member. When the pressing member pivotally rotates, a pressing force is provided for pressing against the adapter, so that the terminals urge against the conducting portion.

In one embodiment, the adapter includes a first body and a second body, and an elastic member located between the first body and the second body. When the conducting portion is not inserted in the slot, the elastic member is urged against the first body and the second body. After the conducting portion is inserted in the slot, the first body moves toward the second body, and the terminals urge against the conducting portion.

In one embodiment, the electrical connection system further includes a plurality of coaxial cables connected to the adapter, such that multiple chip modules are interconnected.

In one embodiment, the terminals include multiple signal terminals and multiple ground terminals. The signal terminal is in electrical contact with an inner conductor of the coaxial cable, and the ground terminal is in contact with an outer conductor of the coaxial cable.

In one embodiment, the electrical connection system further includes a ground piece. The ground piece is welded to the outer conductors of the coaxial cables. Further, the ground piece extends to form multiple ground pins which are welded to the ground terminals.

In one embodiment, the chip module includes a main body. A bottom surface of the main body is provided with a first contact area which is electrically connected to the electrical connector. The conducting portion laterally extends from the main body. An upper and a lower surface of the conducting portion are each provided with a second contact area which is in electrical contact with the adapter.

Compared with the related art, certain embodiments of the present invention, among other things, have the following beneficial advantages.

The slot is formed between the two rows of terminals in the adapter and provided for insertion of the conducting portion. When the chip module is not inserted in the slot, the width of the slot is greater than the thickness of the conducting portion, so that a zero insertion force is required for insertion of the chip module, and the conducting portion may not be worn out. After the chip module is inserted in the slot, under the effect of an external force, the width of the slot is reduced so that the terminals urge against the conducting portion, which ensures close electrical connection between the terminals and the chip module.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
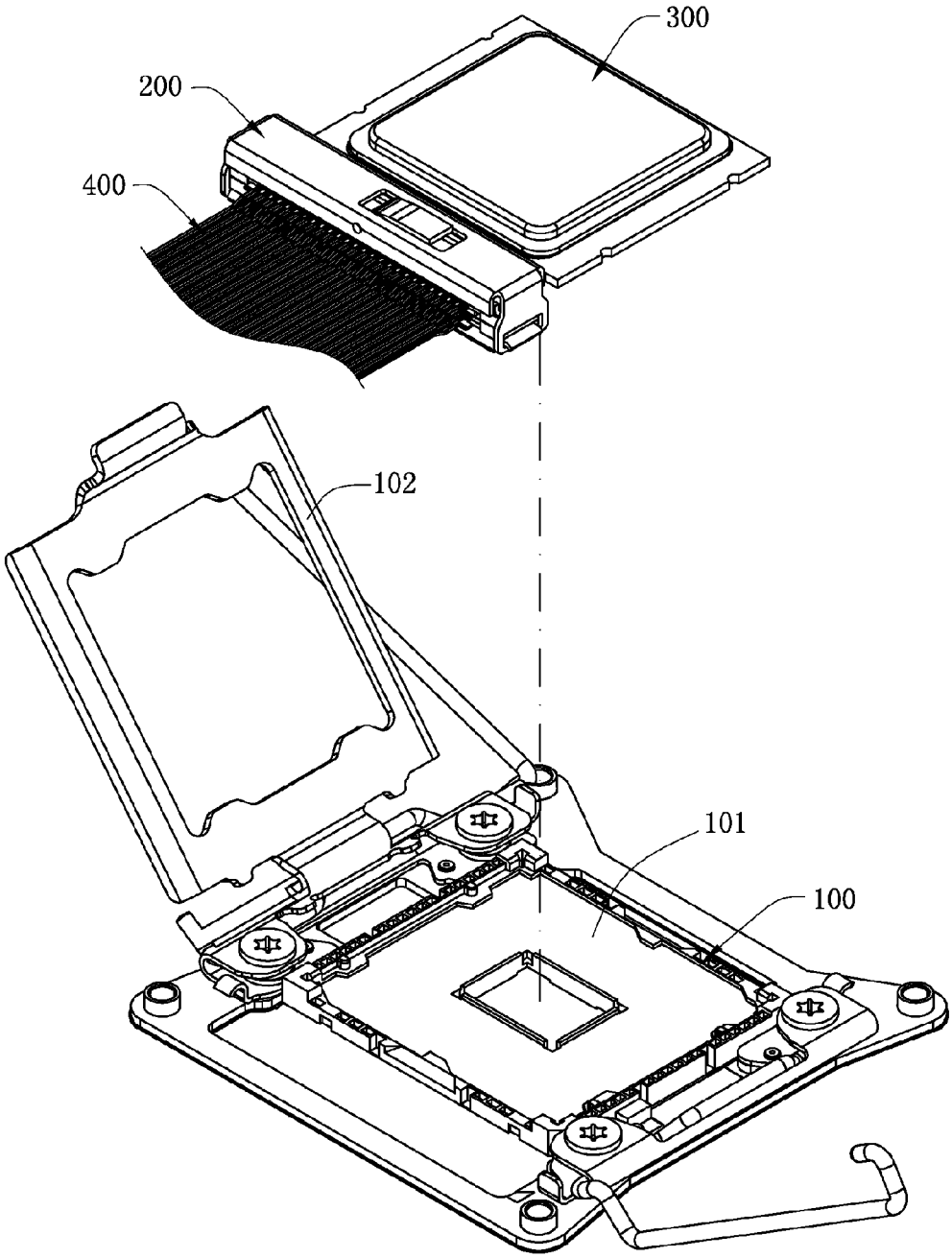
FIG. 1 is a schematic three-dimensional exploded view when a chip module is not inserted in an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-12. In accordance with the purposes of this invention, as embodied and broadly described herein, this invention, in one aspect, relates to an electrical connector.

As shown in FIG. 1, in one embodiment of the present invention, the electrical connection system includes an electrical connector 100 for electrically connecting a chip module 300, and an adapter 200 located on one side of the electrical connector 100 and electrically connected to the chip module 300. A rear end of the adapter 200 is connected to multiple coaxial cables 400. The coaxial cables 400 may connect two adapters 200, so as to achieve interconnection between multiple chip modules 300.

As shown in FIG. 1, the electrical connector 100 includes an insulating body 101 and a cover plate 102 pivotally connected to the insulating body 101. Multiple conducting terminals (not shown) are disposed in the insulating body 101. After the chip module 300 is mounted in the electrical connector 100, the cover plate 102 rotates and presses the chip module 300, so that the chip module 300 is buckled and fastened.

Figure 4:
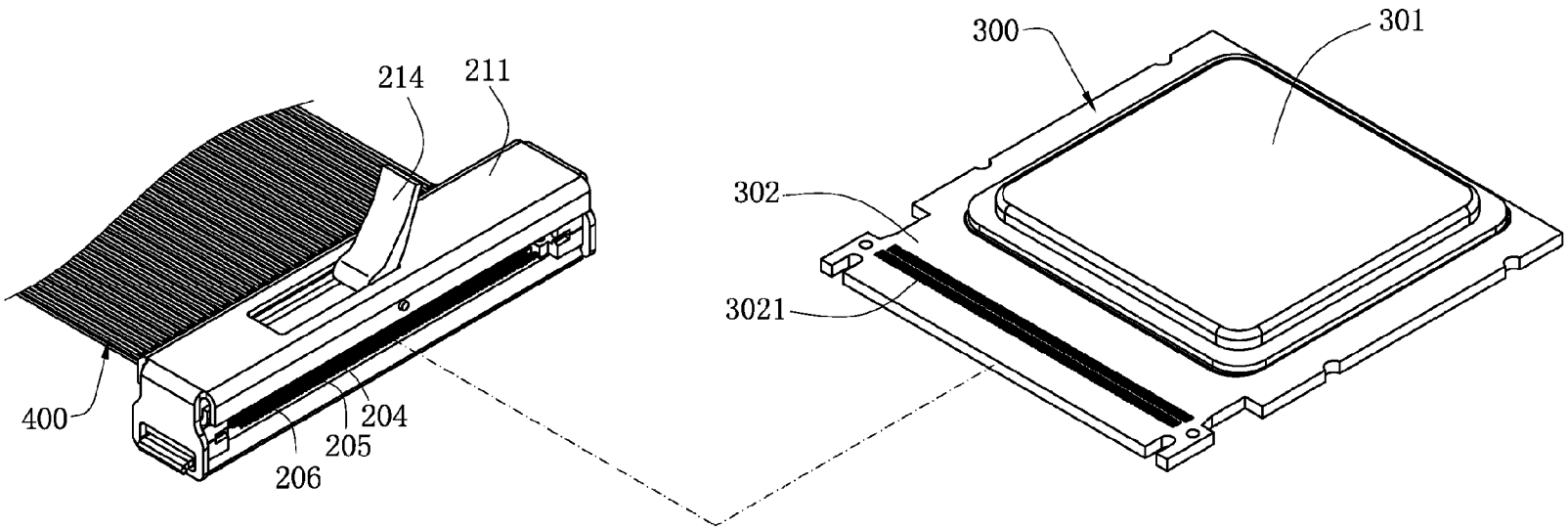
FIG. 4 is a schematic three-dimensional view of the chip module and an adapter according to one embodiment of the present invention.

As shown in FIG. 4, the chip module 300 has a main body 301. The main body 301 is rectangular, and is placed on the insulating body 101. A first contact area (not shown) is provided on a lower surface of the main body 301 and is in electrical contact with the conducting terminals. The main body 301 laterally extends to form a conducting portion 302. An upper and a lower surface of the conducting portion 302 are each provided with multiple second contact areas 3021 for electrical conducting with the adapter 200. In this embodiment, the second contact areas 3021 are multiple metal pads.

Figure 5:
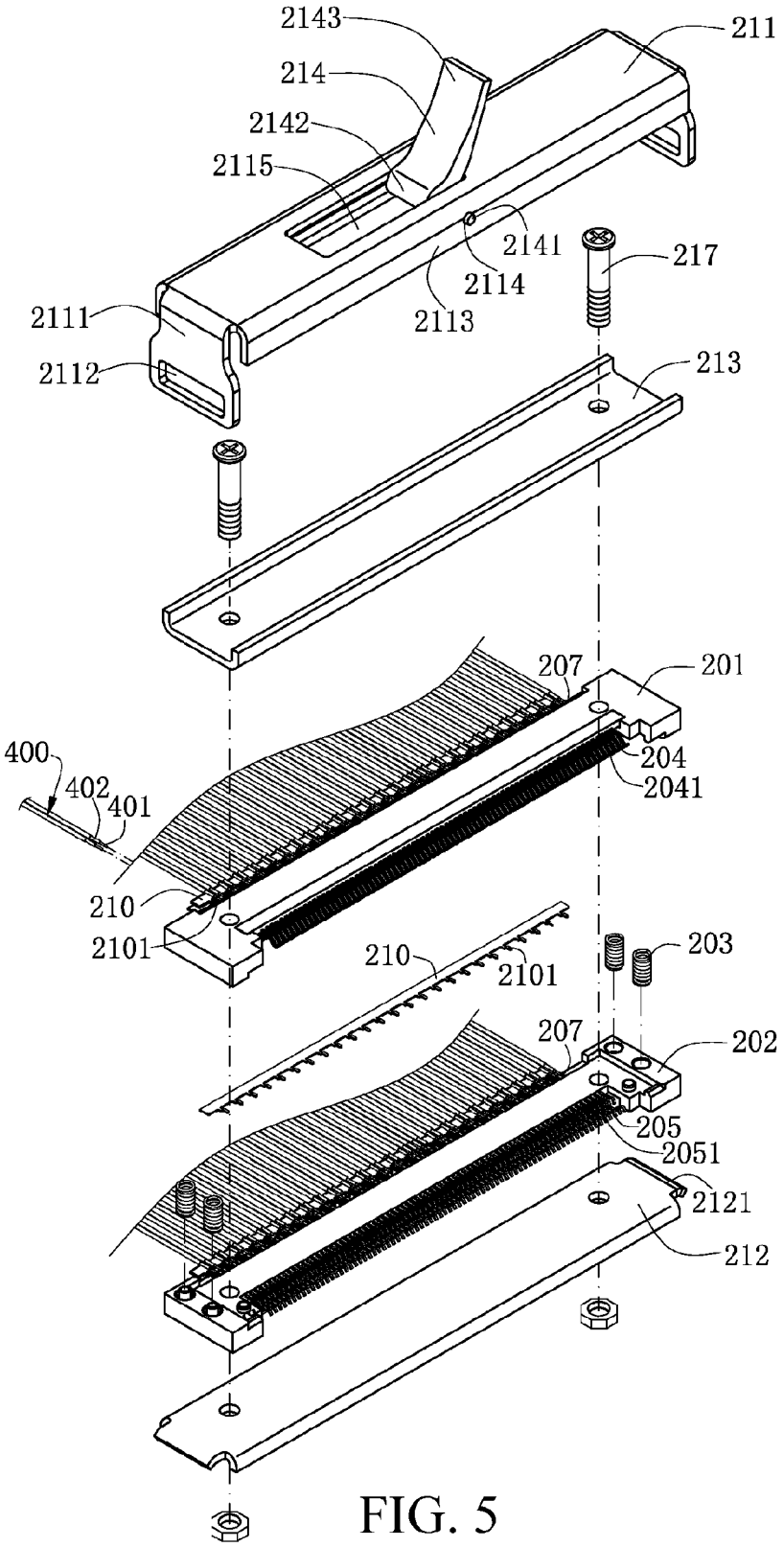
FIG. 5 is a schematic three-dimensional exploded view of the adapter in a first embodiment of the present invention.

As shown in FIG. 4 and FIG. 5, the adapter 200 includes a first body 201 and a second body 202. The first body 201 is located above the second body 202, and an elastic member 203 is provided between the first body 201 and the second body 202. In this embodiment, the elastic member 203 is a spring. Multiple first terminals 204 are disposed in the first body 201, and multiple second terminals 205 are disposed in the second body 202. The first terminals 204 and the second terminals 205 are arranged in rows and disposed opposite to each other. In one embodiment, the first body 201 is insert-molded with the first terminals 204, and the second body 202 is insert-molded with the second terminals 205. Alternatively, the first terminals 204 may also be fixed in the first body 201 in an insertion manner, and the second terminals 205 may also be fixed in the second body 202 in an insertion manner. A slot 206 is formed between the first terminals 204 and the second terminals 205 for the conducting portion 302 to be inserted therein. When the conducting portion 302 is not inserted in the slot 206, the elastic member 203 is urged against the first body 201 and the second body 202, and the width of the slot 206 is greater than the thickness of the conducting portion 302, so that a zero insertion force is required for insertion of the conducting portion 302 in the slot 206, and the conducting portion 302 may not be worn out. After the conducting portion 302 is inserted in the slot 206, a pressing force is applied to the first body 201 to press against the elastic member 203, so that the first body 201 and the first terminals 204 move toward the second body 202, and the width of the slot 206 is gradually reduced to be equal to the thickness of the conducting portion 302. In this manner, the first terminals 204 and the second terminals 205 respectively urge against the second contact areas 3021, and are tightly clamped to the conducting portion 302, to prevent fall-off of the conducting portion 302.

Figure 3:
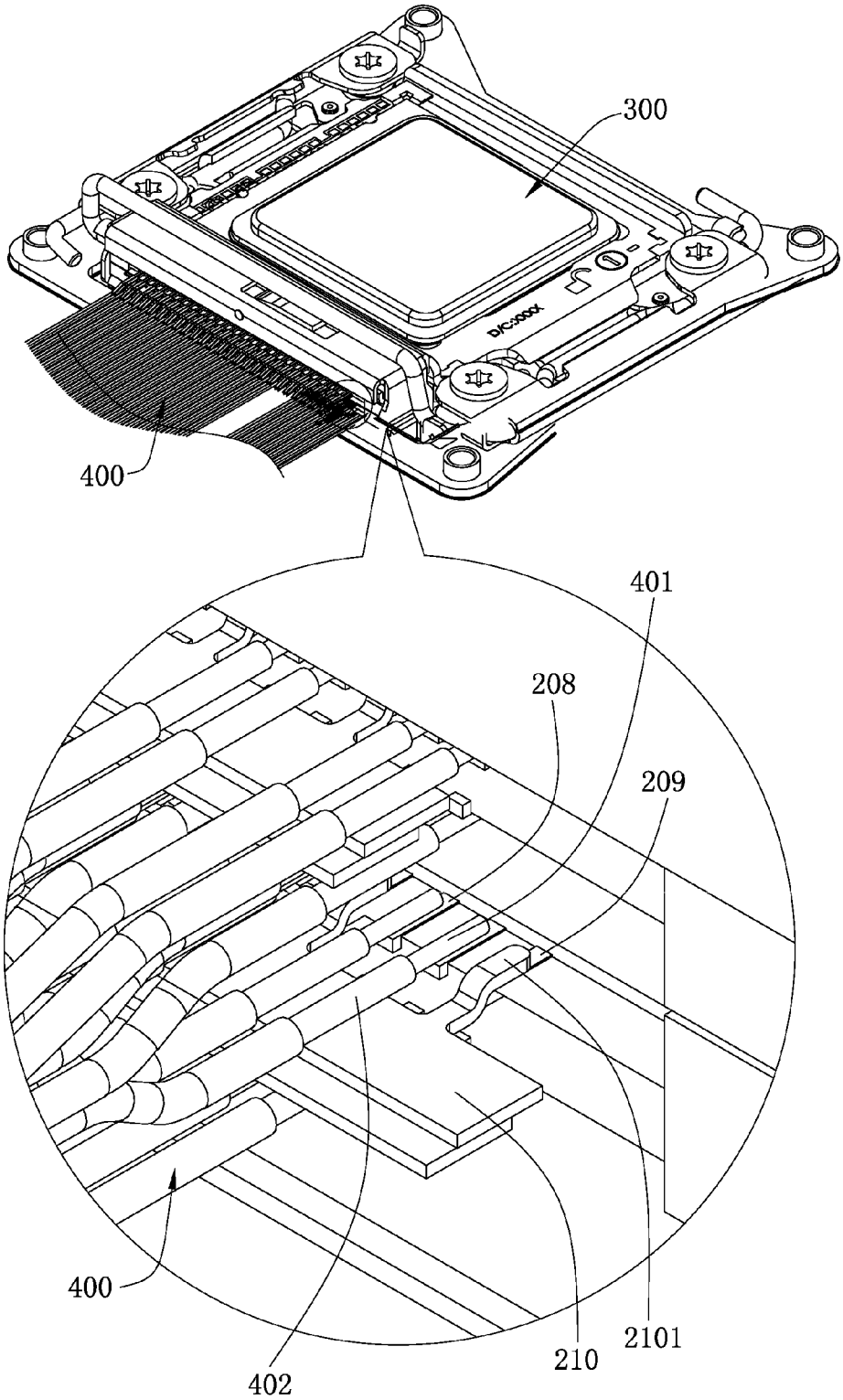
FIG. 3 is a schematic three-dimensional combined view and a partial enlarged view of a cover plate being buckled in the electrical connector according to one embodiment of the invention.

As shown in FIGS. 3-5, two rows of first terminals 204 and two rows of second terminals 205 are respectively arranged on upper and lower sides of the slot 206. The first terminal 204 has a first contact portion 2041 exposed out of the slot 206, the second terminal 205 has a second contact portion 2051 exposed out of the slot 206, and the first contact portions 2041 and the second contact portions 2051 are arranged in two rows in the insertion direction of the chip module 300 and are located in the same plane. Correspondingly, the second contact areas 3021 on the upper and the lower surface of the conducting portion 302 are respectively in electrical contact with the first contact portions 2041 and the second contact portions 2051. A rear end of each of the first terminals 204 and the second terminals 205 is provided with a rear portion 207 for electrically connecting the coaxial cable 400. The first terminals 204 and the second terminals 205 include multiple signal terminals 208 and multiple ground terminals 209, respectively. A pair of the signal terminal 208 and the ground terminal 209 in each row of the first terminals 204 is adjacently arranged in an alternate manner. In this embodiment, the rear portion 207 of the signal terminal 208 is welded on an inner conductor 401 of the coaxial cable 400, and the rear portion 207 of the ground terminal 209 is welded to an outer conductor 402 of the coaxial cable 400. In one embodiment, a ground piece 210 is further provided in the adapter 200. The ground piece 210 is welded to the outer conductors 402 of the coaxial cables 400. The ground piece 210 extends to form multiple ground pins 2101 respectively welded with the rear portions 207 of the ground terminals 209, and the multiple ground terminals 209 are grounded through the ground piece 210, thereby ensuring the grounding effect.

Figure 6:
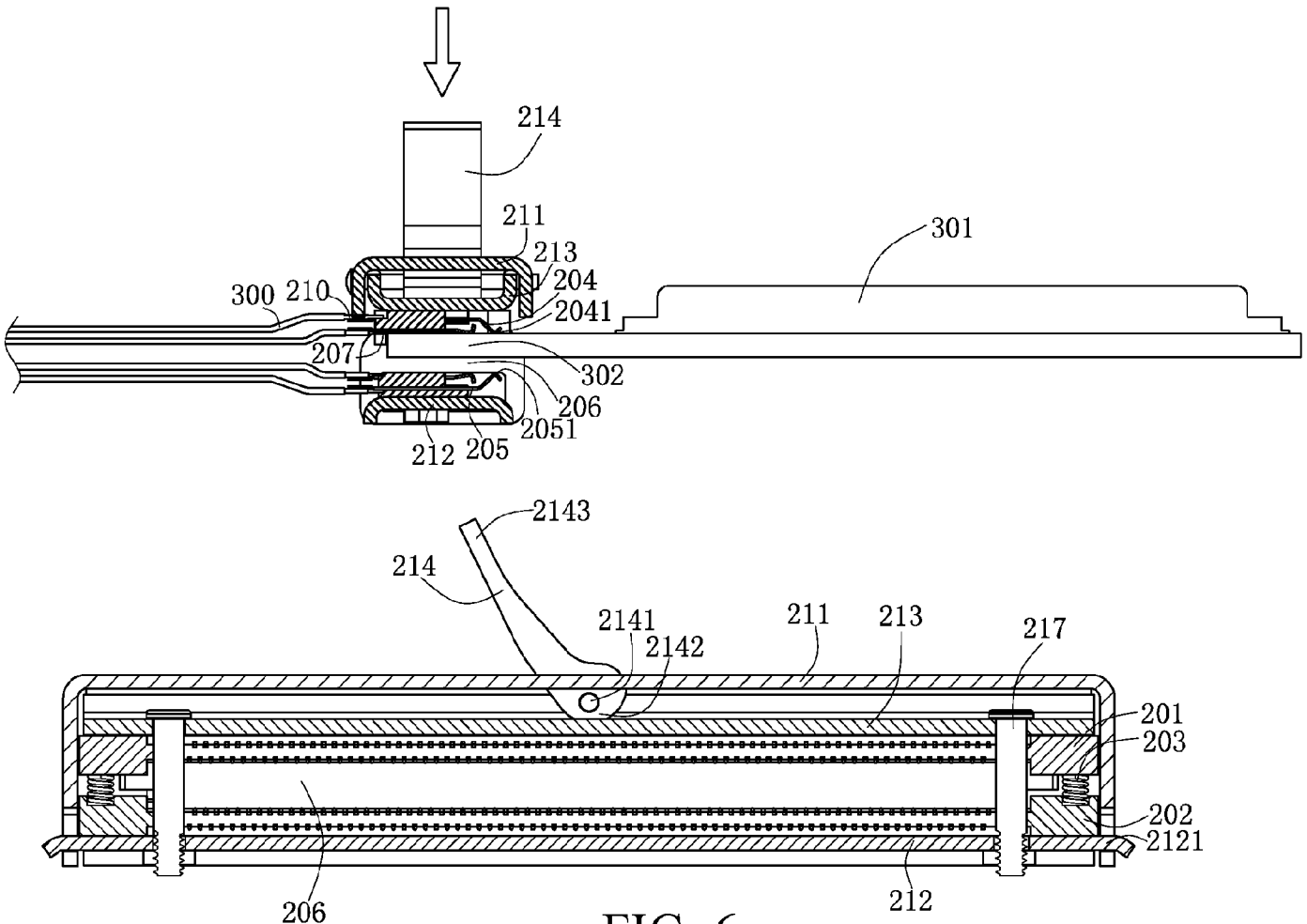
FIG. 6 is a schematic cross-sectional view when a pressing member does not provide a pressing force to the adapter according to one embodiment of the present invention.
Figure 7:
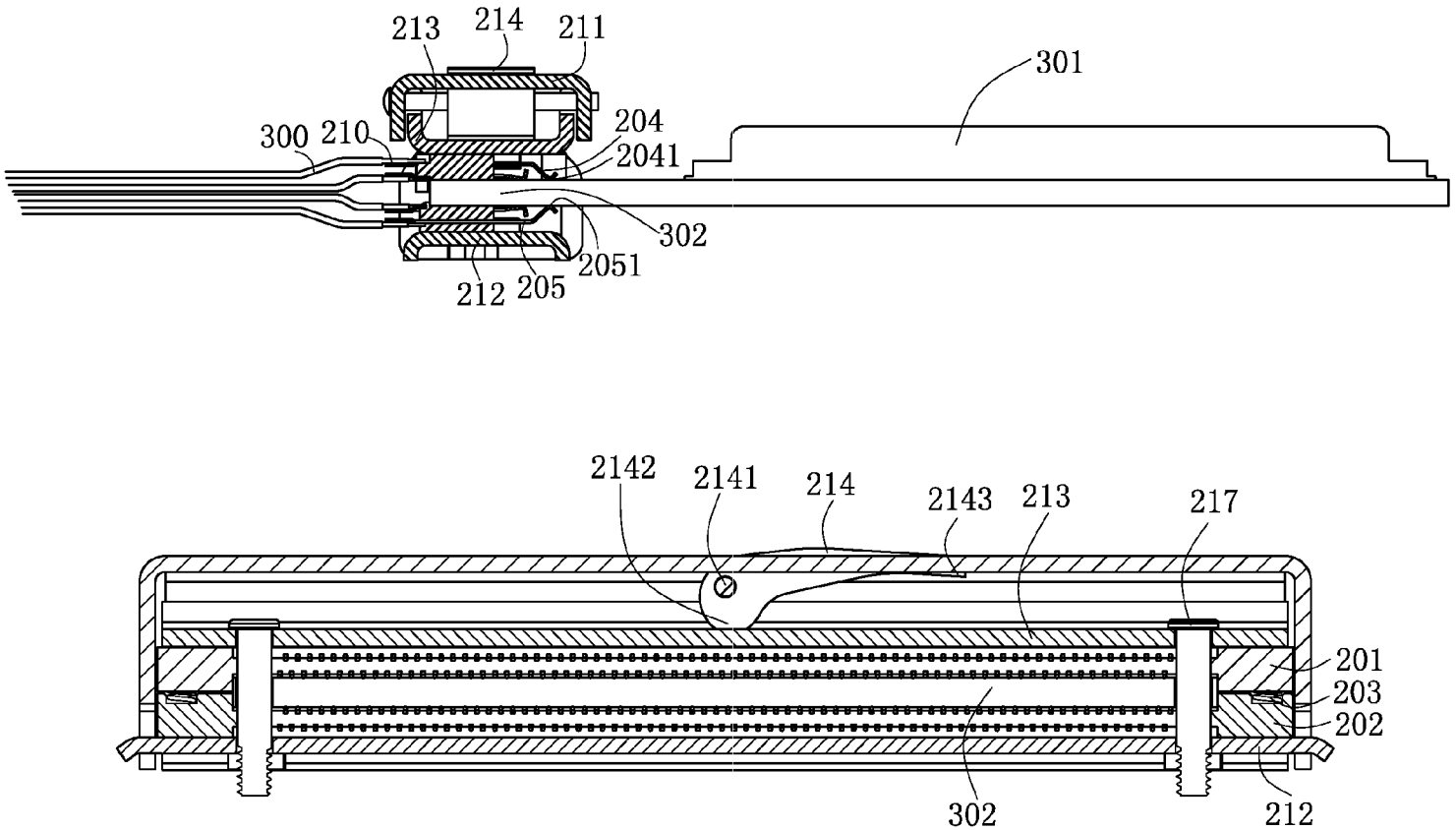
FIG. 7 is a schematic cross-sectional view of the pressing member pressing against the adapter after the chip module is inserted in a slot according to one embodiment of the present invention.

As shown in FIG. 5, in the first embodiment, the adapter 200 further includes a fixing plate 211 located above the first body 201, and a bottom plate 212 located below the second body 202. A pressing plate 213 is provided between the fixing plate 211 and the first body 201, and the pressing plate 213 is made of a metal material. A pressing force is applied to the pressing plate 213 to press against the first body 201, so as not to damage the first body 201. The pressing plate 213 and the bottom plate 212 are fixed through a screw 217. The fixing plate 211 covers a top surface of the pressing plate 213. Two ends of the fixing plate 211 are each bent downward and extend to form a retaining portion 2111, and the retaining portion 2111 is provided with a buckling hole 2112. Two ends of the bottom plate 212 are each provided with a buckling portion 2121 correspondingly, and the buckling portions 2121 can enter and engage with the buckling holes 2112, so as to limit the first body 201 and the second body 202. Each of two side edges of the fixing plate 211 extends downward to form a baffle plate 2113, for retaining two sides of the pressing plate 213 and the first body 201. Each of the two baffle plates 2113 is provided with a pivotal connection hole 2114 for pivotal connection of a pressing member 214. The fixing plate 211 is provided with an opening 2115 for accommodating the pressing member 214, and the pressing member 214 in pivotal rotation may be located in the opening 2115. The pressing member 214 includes a pivotal connection portion 2141 pivotally connected with the pivotal connection holes 2114, and a pressing portion 2142 provided on one side of the pressing member adjacent to the pivotal connection portion 2141. In this embodiment, the pressing portion 2142 is in the shape of a cam, and an operating portion 2143 is provided on another side of the pressing member 214 away from the pivotal connection portion 2141. As shown in FIG. 6 and FIG. 7, when the chip module 300 is not inserted in the adapter 200, the pressing member 214 is in an open state, the operating portion 2143 stands upright, and in this case, the first body 201 is not pressed, the elastic member 203 is urged upward against the first body 201, and the width of the slot 206 is greater than the thickness of the conducting portion 302, so that a zero insertion force is required for insertion of the chip module 300, and the conducting portion 302 may not be worn out. After the chip module 300 is inserted, a pressing force is applied to the operating portion 2143 to make the pressing member 214 rotate around the pivotal connection portion 2141 toward the first body 201. The pressing portion 2142 rotates to press against the pressing plate 213, thus the pressing plate 213 presses a top surface of the first body 201, and continues to press downward against the operating portion 2143 till the operating portion 2143 is located in the opening 2115. The first body 201 is pressed to make the first body 201 move downward till the first terminals 204 and the second terminals 205 closely urge against the conducting portion 302, and the width of the slot 206 is reduced to be equal to the thickness of the conducting portion 302. The pressing member 214 can be used to provide a pressing force on the first body 201, so that the width of the slot 206 is reduced and the operation is convenient.

Figure 2:
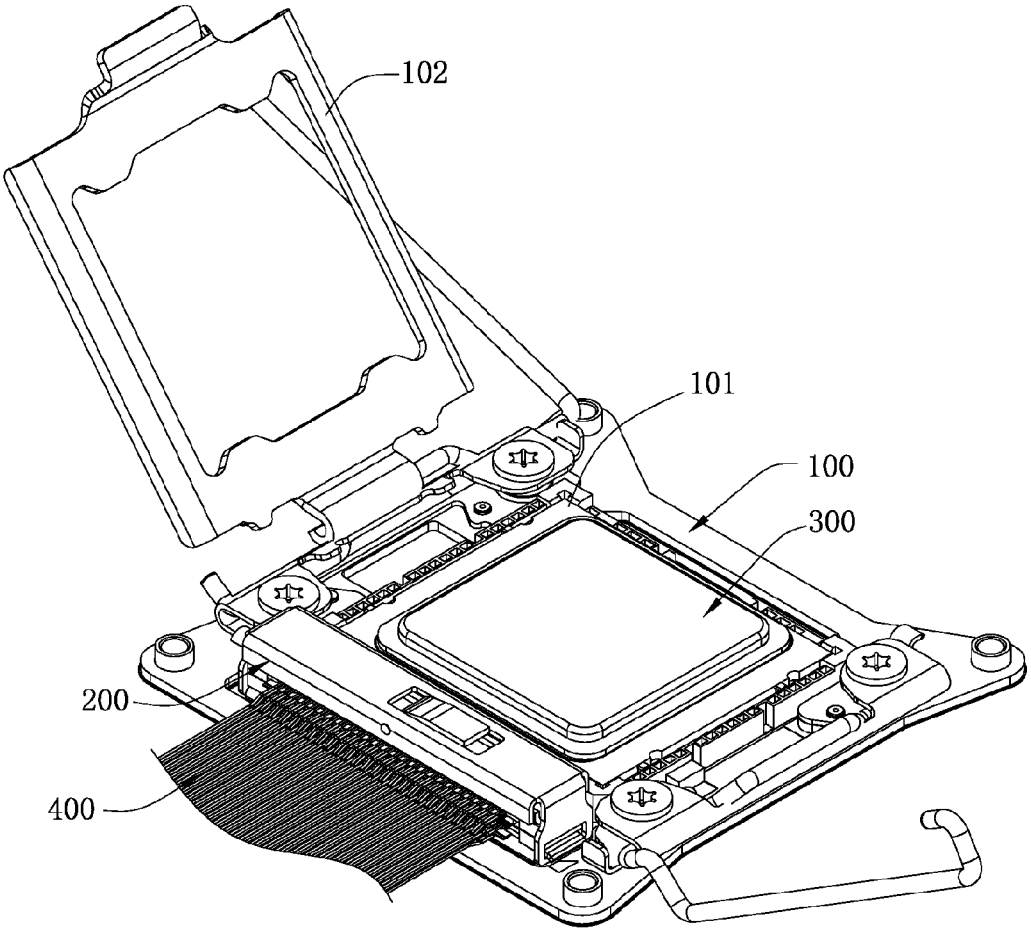
FIG. 2 is a schematic three-dimensional view after the chip module is inserted in the electrical connector according to one embodiment of the present invention.

As shown in FIGS. 1-3, in operation, the chip module 300 is first mounted in the adapter 200, that is, the conducting portion 302 is inserted in the slot 206. Under this situation, the width of the slot 206 is greater than the thickness of the conducting portion 302, so that a zero insertion force is required for insertion of the conducting portion 302 in the slot 206. Then, the operating portion 2143 is pressed so that the pressing portion 2142 presses the pressing plate 213, and the pressing plate 213 further presses the first body 201 to make the first body 201 move toward the second body 202, so that the first terminals 204 and the second terminals 205 closely urge against the conducting portion 302, which ensures close electrical connection between the chip module 300 and the adapter 200. Finally, the cover plate 102 is tightly buckled, and the first contact area of the chip module 300 is electrically conducted to the conducting terminals.

Figure 9:
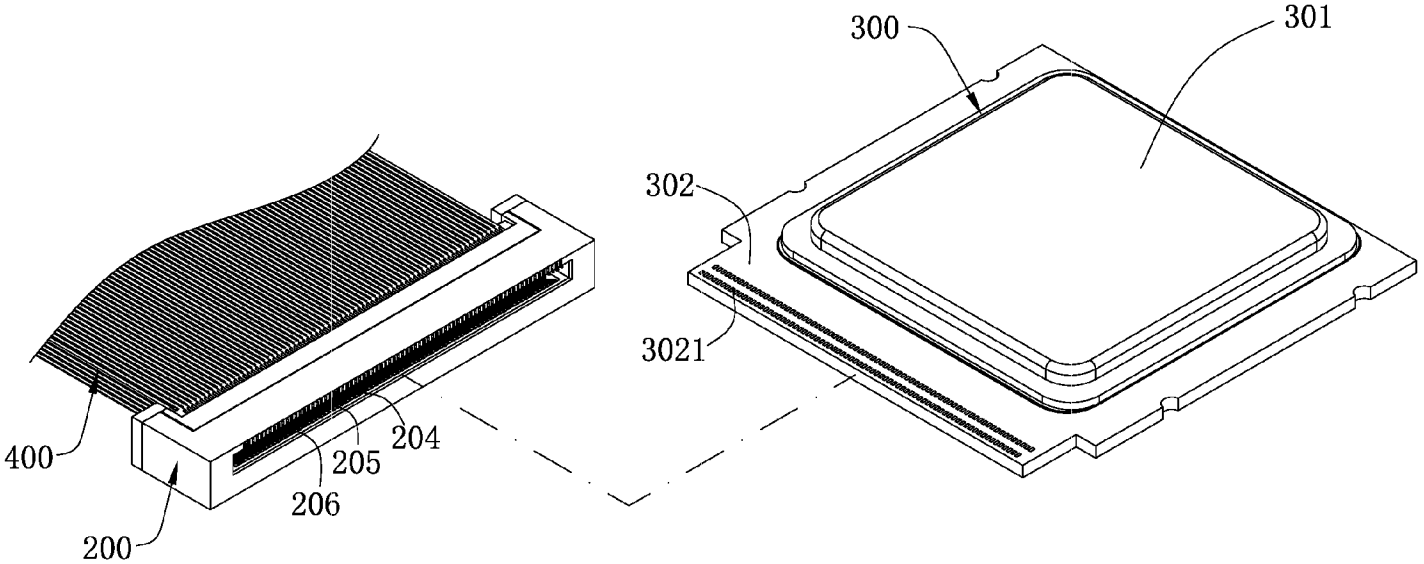
FIG. 9 is a schematic three-dimensional view of the chip module and the adapter in the second embodiment of the present invention.
Figure 10:
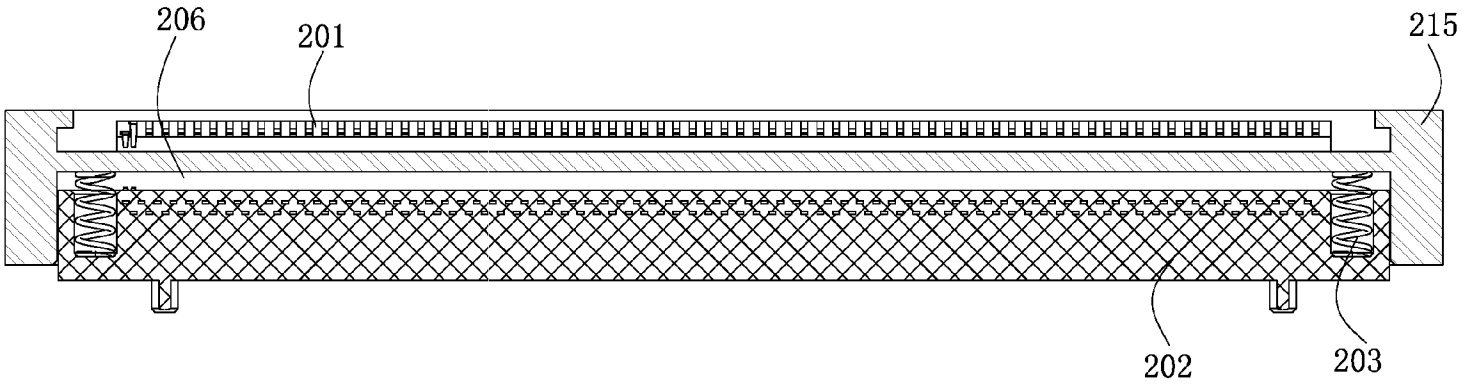
FIG. 10 is a front view of the adapter in the second embodiment of the present invention.
Figure 11:
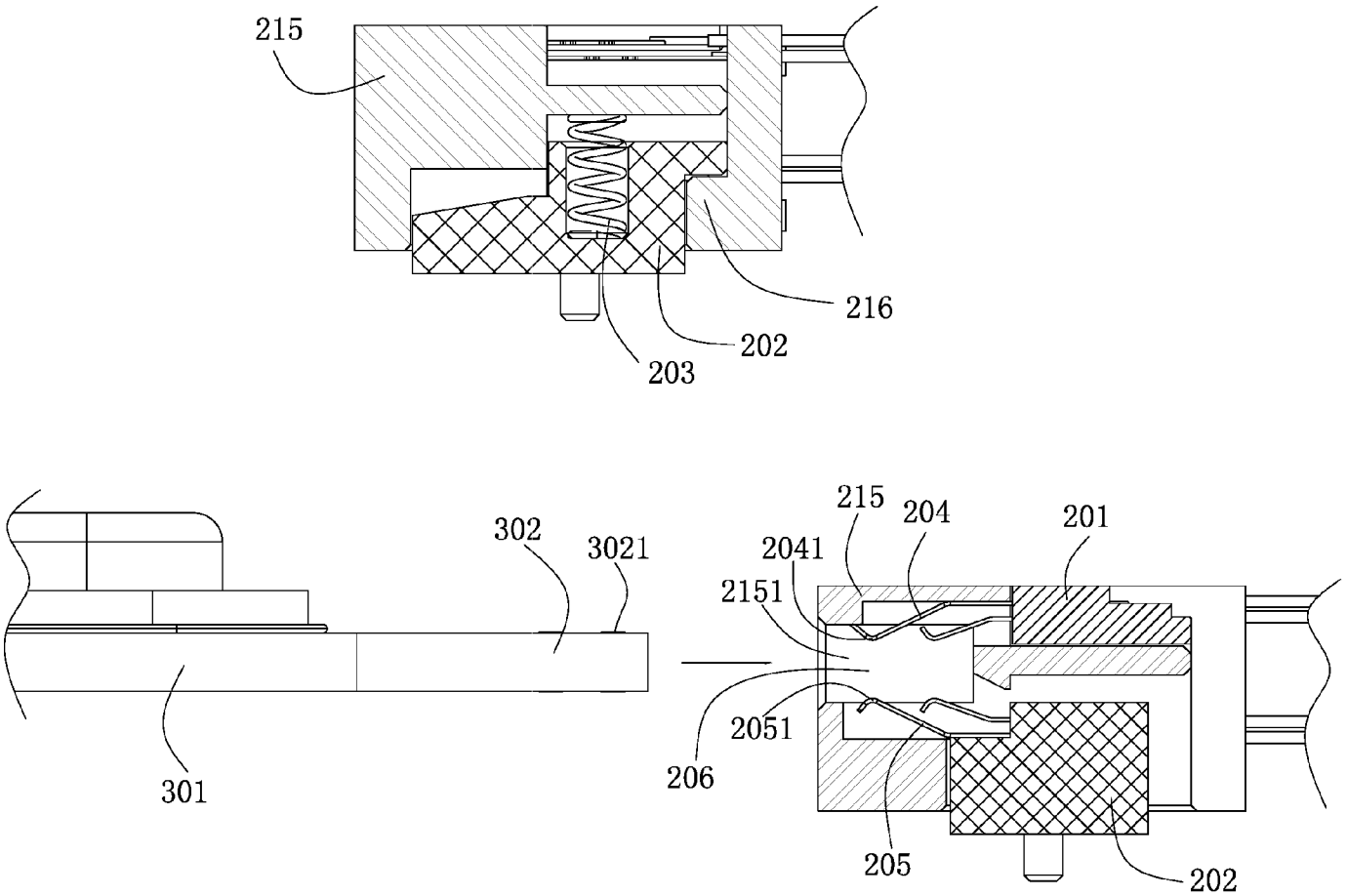
FIG. 11 is a schematic cross-sectional view when the chip module is not inserted in the adapter according to one embodiment of the present invention.
Figure 12:
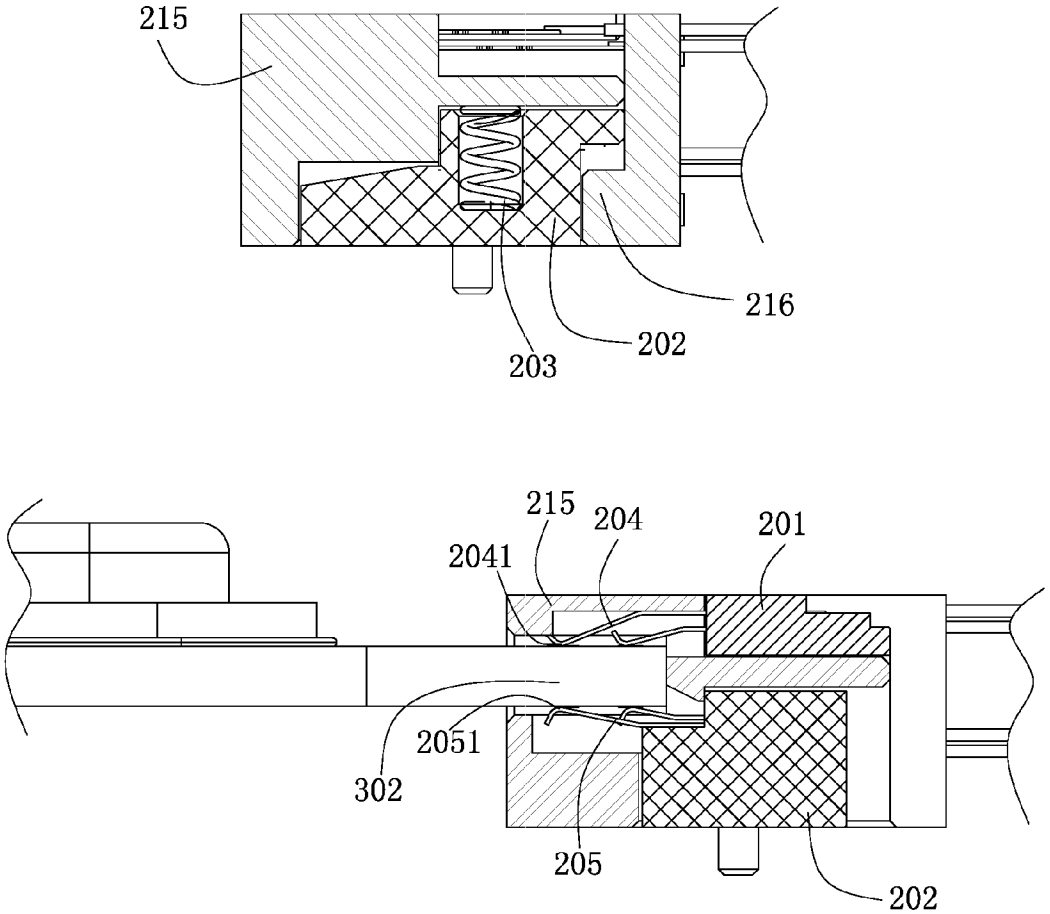
FIG. 12 is a schematic cross-sectional view after the chip module is inserted in the adapter according to one embodiment of the present invention.

As shown in FIG. 9, in a second embodiment, the structure of the electrical connector 100 is the same as that in the first embodiment, the first body 201 and the second body 202 are provided in the adapter 200, and the elastic member 203 is provided between the first body 201 and the second body 202. As shown in FIG. 10 to FIG. 12, different from the first embodiment, the adapter 200 further includes a third body 215. The third body 215 is located on one side of the first body 201 and the second body 202 facing the electrical connector 100. The third body 215 has a groove 2151 for insertion of the conducting portion 302. The first terminals 204 and the second terminals 205 in the first body 201 and the second body 202 enter the groove 2151 and are located on upper and lower sides of the groove 2151. The third body 215 and the first body 201 are fixed through a convex-concave fitting structure. A protruding block 216 is provided on the first body 201, and the protruding block 216 laterally extends downward and retains the second body 202, to limit the displacement of the second body 202 and prevent fall-off of the second body 202. When the chip module 300 is not inserted in the adapter 200, under the urging force of the elastic member 203, a distance exists between the first body 201 and the second body 202, and the width of the slot 206 is greater than the thickness of the conducting portion 302. After the conducting portion 302 is inserted in the groove 2151, the first body 201 and/or the third body 215 is pressed to make the first body 201 move toward the second body 202 till the first body 201 urge against the second body 202. Therefore, the first terminals 204 and the second terminals 205 closely urge against the conducting portion 302.

Figure 8:
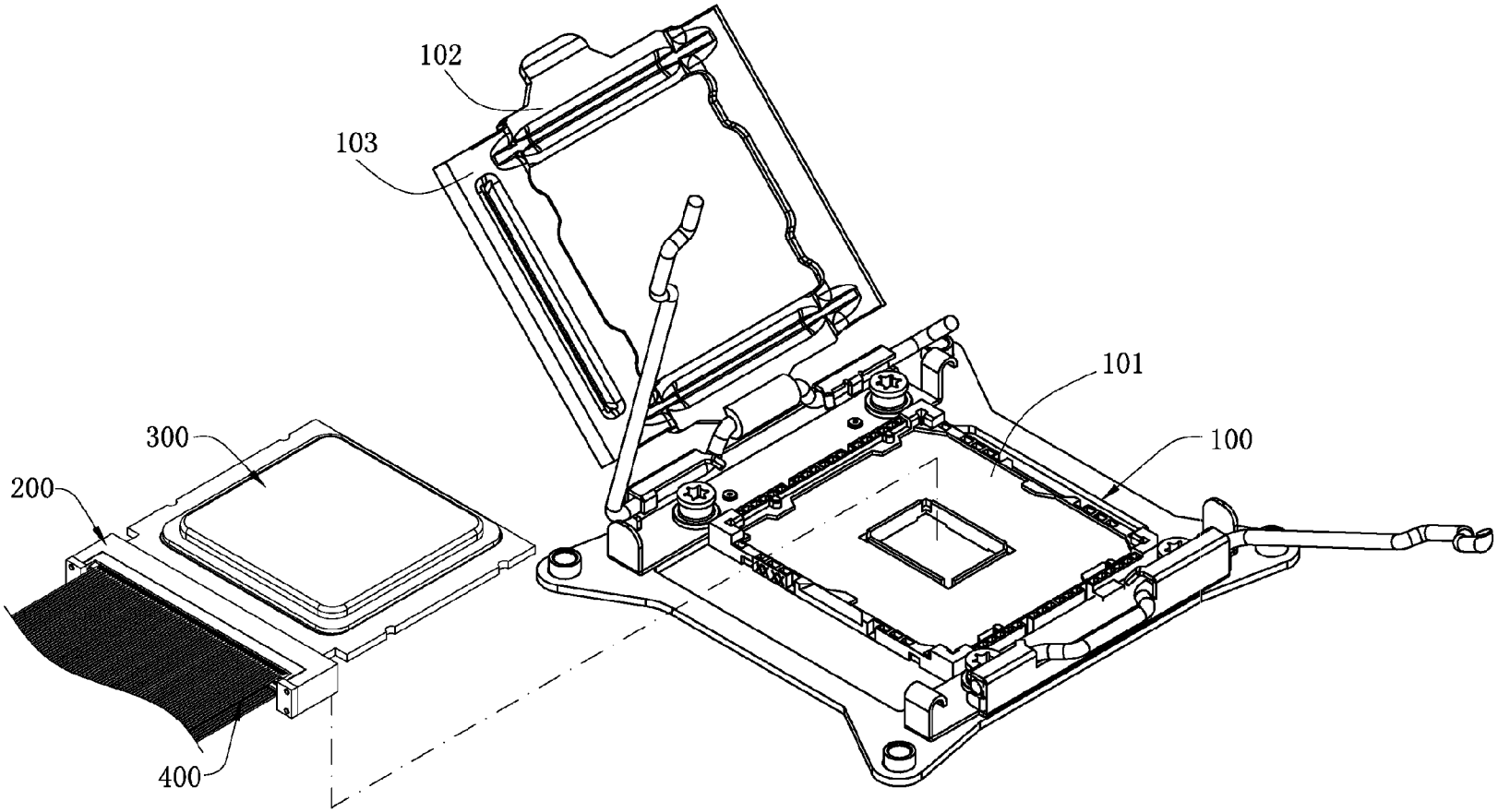
FIG. 8 is a schematic three-dimensional exploded view of an electrical connection system in a second embodiment of the present invention.

As shown in FIG. 8 and FIG. 10, in this embodiment, the cover plate 102 laterally extends toward one side of the adapter 200 to form an urging portion 103. After the chip module 300 is mounted in the electrical connector 100 and is inserted in the groove 2151, the cover plate 102 rotates to press against the chip module 300, and the urging portion 103 presses the top surface of the first body 201, so that the first body 201 moves downward. The cover plate 102 provides a pressing force so that the width of the slot 206 is reduced to be equal to the thickness of the conducting portion 302. In one embodiment, in the first embodiment, the urging portion 103 may also be disposed on the cover plate 102 for urging against the pressing member 214. When the cover plate 102 is buckled, the pressing member 214 can be automatically pressed to further provide a pressing force to the first body 201 to make the first body 201 move toward the second body 202.

In view of the above, the adapter and the electrical connection system according to certain embodiment of the present invention, among other things, have the following beneficial advantages.

(1) When the conducting portion 302 is not inserted in the slot 206, the elastic member 203 is urged against the first body 201 and the second body 202, and the width of the slot 206 is greater than the thickness of the conducting portion 302, so that a zero insertion force is required for insertion of the conducting portion 302 in the slot 206, and the conducting portion 302 may not be worn out. After the conducting portion 302 is inserted in the slot 206, a pressing force is applied to the first body 201 to press against the elastic member 203, so that the first body 201 and the first terminals 204 move toward the second body 202, and the width of the slot 206 is gradually reduced to be equal to the thickness of the conducting portion 302. In this manner, the first terminals 204 and the second terminals 205 respectively urge against the second contact areas 3021, and are tightly clamped to the conducting portion 302, to prevent fall-off of the conducting portion 302.

(2) The pressing member 214 is pivotally connected to the fixing plate 211, the pressing portion 2142 is provided on one end of the pressing member 214, the operating portion 2143 is provided on the other end of the pressing member 214, the operating portion 2143 rotates to make the pressing portion 2142 provide a pressing force on the first body 201, so that the width of the slot 206 is reduced and the operation is convenient.

(3) The cover plate 102 laterally extends toward one side of the adapter 200 to form an urging portion 103, and after the chip module 300 is mounted in the electrical connector 100 and is inserted in the slot 206, the cover plate 102 rotates to press against the chip module 300, and the urging portion 103 presses the top surface of the first body 201. Therefore, when the cover plate 102 is buckled, the first body 201 can be automatically pressed to move toward the second body 202.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An adapter, comprising:

a first body having a plurality of first terminals disposed therein;

a second body having a plurality of second terminals disposed therein, wherein a slot is formed between the first terminals and the second terminals for a chip module to be inserted therein, the chip module laterally extends to form a conducting portion to enter the slot, and each of the first terminals and the second terminals has a contact portion for contacting the chip module and a rear portion for electrically connecting a coaxial cable; and an elastic member, urges against the first body and the second body, wherein when the chip module is not inserted in the slot, the elastic member is urged against the first body and the second body, and a width of the slot is greater than a thickness of the conducting portion; and wherein when the chip module is inserted in the slot, a pressing force is applied to the first body to press against the elastic member, so that the first body and the first terminals move toward the second body, and the width of the slot is gradually reduced to be equal to the thickness of the conducting portion.

2. The adapter of claim 1, wherein the elastic member is located between the first body and the second body.

3. The adapter of claim 1, wherein a protruding block is provided on the first body and retains the second body to limit the displacement thereof.

4. The adapter of claim 1, further comprising a third body fixed on the first body, wherein the first terminals and the second terminals extend into the third body and are disposed opposite to each other.

5. The adapter of claim 1, wherein the first body is insert-molded with the first terminals, and the second body is insert-molded with the second terminals.

6. The adapter of claim 1, wherein the first terminals comprise multiple signal terminals and multiple ground terminals, at least one of the multiple signal terminals is in electrical contact with an inner conductor of the coaxial cable, and at least one of the multiple ground terminals is in contact with an outer conductor of the coaxial cable.

7. The adapter of claim 6, further comprising a ground piece welded to the outer conductor of the coaxial cable, wherein the ground piece extends to form multiple ground pins welded to the multiple ground terminals.

8. An adapter comprising:

a first body having a plurality of first terminals disposed therein;

a second body having a plurality of second terminals disposed therein, wherein a slot is formed between the first terminals and the second terminals for a chip module to be inserted therein, and the chip module laterally extends to form a conducting portion to enter the slot;

an elastic member, urges against the first body and the second body;

a fixing plate located on one side of the first body away from the second body; and a pressing member pivotally connected to the fixing plate, wherein when the chip module is not inserted in the slot, the elastic member is urged against the first body and the second body, and a width of the slot is greater than a thickness of the conducting portion;

wherein when the chip module is inserted in the slot, a pressing force is applied to the first body to press against the elastic member, so that the first body and the first terminals move toward the second body, and the width of the slot is gradually reduced to be equal to the thickness of the conducting portion; and wherein when the conducting portion is not inserted in the slot, the pressing member is located at an open position, and after the conducting portion is inserted in the slot, a pressing force is applied to the pressing member so that the pressing member rotates and provides a pressing force to the first body, the first body moves toward the second body, and the first terminals and the second terminals urge against the conducting portion.

9. The adapter of claim 8, further comprising a pressing plate located between the fixing plate and the first body, wherein when the pressing member rotates and presses the pressing plate, the pressing plate presses the first body.

10. The adapter of claim 8, wherein the fixing plate is provided with an opening for accommodating the pressing member.

11. The adapter of claim 8, further comprising a bottom plate located on one side of the second body away from the first body, wherein each of two ends of the bottom plate is provided with a buckling portion, each of two ends of the fixing plate is bent and extended to form a retaining portion, and the buckling portions are engaged with the retaining portions.

12. The adapter of claim 8, wherein the pressing member comprises:

a pivotal connection portion pivotally connected to the fixing plate, a pressing portion for providing a pressing force to the first body, disposed on a first end of the pressing member adjacent to the pivotal connection portion; and an operating portion, disposed on a second end of the pressing member away from the pressing portion.

13. The adapter of claim 12, wherein the pressing portion is in the shape of a cam.

14. An electrical connection system, comprising:

an electrical connector electrically connected to a chip module, the chip module being laterally extended to form a conducting portion;

an adapter disposed on one side of the electrical connector, two rows of terminals being disposed in the adapter, a slot being formed between the two rows of terminals for the conducting portion to be inserted therein; and a plurality of coaxial cables connected to the adapter, such that multiple chip modules are interconnected, wherein when the conducting portion is not inserted in the slot, a width of the slot is greater than the thickness of the conducting portion, and after the chip module is inserted in the slot, under the effect of an external force, the width of the slot is reduced so that the terminals urge against the conducting portion.

15. The electrical connection system of claim 14, wherein the electrical connector comprises a cover plate for pressing the chip module, one side of the cover plate extends to form an urging portion, and the urging portion is urged against the adapter to provide a pressing force.

16. The electrical connection system of claim 14, wherein the adapter comprises a fixing plate, the fixing plate is pivotally provided with a pressing member, and when the pressing member pivotally rotates, a pressing force is provided for pressing the adapter, such that the terminals urge against the conducting portion.

17. The electrical connection system of claim 14, wherein the adapter comprises a first body, a second body, and an elastic member located between the first body and the second body; and wherein when the conducting portion is not inserted in the slot, the elastic member is urged against the first body and the second body, and after the conducting portion is inserted in the slot, the first body moves toward the second body, and the terminals urge against the conducting portion.

18. The electrical connector system of claim 14, wherein the chip module comprises a main body, a bottom surface of the main body is provided with a first contact area for electrically connecting the electrical connector, the conducting portion laterally extends from the main body, and an upper and a lower surface of the conducting portion are each provided with a second contact area electrically contacting the adapter.

19. The electrical connection system of claim 14, wherein the terminals comprise multiple signal terminals and multiple ground terminals, each of the multiple signal terminals is in electrical contact with an inner conductor of at least one of the plurality of the coaxial cables, and each of the multiple ground terminals is in contact with an outer conductor of at least one of the plurality of the coaxial cables.

20. The electrical connector system of claim 19, further comprising a ground piece, wherein the ground piece is welded to outer conductors of the plurality of coaxial cables, and the ground piece extends to form multiple ground pins welded to the multiple ground terminals.

* * * * *